US005511506A

United States Patent [19]

Bruce

[11] Patent Number: 5,511,506

[45] Date of Patent: Apr. 30, 1996

[54] MARINE ANCHOR

[75] Inventor: Peter Bruce, Onchan, Isle of Man

[73] Assignee: Brupat Limited, Onchan, Isle of Man

[21] Appl. No.: 150,070

[22] PCT Filed: May 21, 1992

[86] PCT No.: PCT/GB92/00921

§ 371 Date: Feb. 17, 1994

§ 102(e) Date: Feb. 17, 1994

[87] PCT Pub. No.: WO92/20569

PCT Pub. Date: Nov. 26, 1992

[30] Foreign Application Priority Data

May 21, 1991 [GB] United Kingdom ..... 9110950

[51] Int. Cl.[6] ..... B63B 21/32

[52] U.S. Cl. ..... 114/301; 114/310

[58] Field of Search ..... 114/294, 301, 114/304, 310

[56] References Cited

U.S. PATENT DOCUMENTS

| | | | |
|---|---|---|---|
| 2,743,695 | 5/1956 | Bowman | 114/310 X |
| 3,685,479 | 8/1972 | Bruce | 114/230 |
| 4,523,539 | 6/1985 | Granger | 114/301 X |

FOREIGN PATENT DOCUMENTS

| | | | |
|---|---|---|---|
| 196801 | 10/1986 | European Pat. Off. . | |
| 220758 | 5/1987 | European Pat. Off. . | |
| 3639023 | 6/1987 | Germany | 114/301 |
| 1509524 | 5/1978 | United Kingdom | 114/301 |
| WO85/05084 | 11/1985 | WIPO . | |

OTHER PUBLICATIONS

K. P. Farrell, "Improvements in Mooring Anchors,"; Quarterly Transactions of the Institution of Naval Architects, vol. 92, No. 4, pp. 335–350 (Oct. 1950).

*Primary Examiner*—Sherman Basinger

*Attorney, Agent, or Firm*—Popham, Haik, Schnobrich & Kaufman, Ltd.

[57] ABSTRACT

A marine anchor has an anhedral fluke with a shank attached thereto including an anchor line attachment point. A rear plate assembly behind the fluke is inclined at an obtuse angle α to the fluke and serves to provide a turning moment about the attachment point countering turning moments produced by friction effect on the fluke and the shank and by edge resistance during anchor burial to give improved anchor holding power while soil escapes the passage between the rear assembly and the fluke allows escape of sand and soft mud passing over the fluke. Peripheral edges of the rear assembly are shaped to cause rolling of the anchor to a burial position. An upturned toe portion at the front of the fluke encourages effective anchor operation in clay soils while also facilitating rock gripping by the anchor.

51 Claims, 5 Drawing Sheets

MARINE ANCHOR

BACKGROUND OF THE INVENTION

1. Field of the Invention

The present invention relates to marine anchors.

2. Description of the Prior Art

The fundamental requirement of a marine anchor is an ability to dig into a mooring bed when pulled forwardly, and to remain stable in the dug-in attitude in the bed when pulled further, it is also well established that for high holding power the anchor should be relatively deeply buried during anchor setting. The nature of mooring beds varies enormously, for example, from hard soils of granular noncohesive dense gravels and sands or cohesive stiff clays to soft soils of cohesive muds. The mooring bed may also be rocky whereupon the anchors must be able to hook satisfactorily onto a rock for mooring. Satisfactory operation of an anchor in a particular mooring bed has necessitated the anchor to have a particular geometry including a fluke angle compatible with the mooring bed soil. The fluke angle is the angle formed between the fluke and a line in a fore-and-aft plane of symmetry of the anchor extending between the rear of the fluke and an anchor line attachment point in the forward end of the shank. At present, it is known, (see, for example, The Quarterly Transactions of the Institute of Naval Architects, Vol. 92, No. 4 Oct. , 1950, pps. 341–343) that for operation in a sand bed a low fluke angle in the range 23° to 32° provides peak holding power in the deepest burying anchors. Fluke angles of 25° to 32° for medium dense to loose sands generally provide satisfactory performance. For a relatively soft mud bed, the fluke angle for peak performance is larger and is in the region of 50° to 55°. In sand with fluke angles over 32°, the moment about the anchor line attachment point of the resultant of soil normal pressure and friction forces on an anchor fluke is insufficient to counterbalance the sum of the moments about the same point of soil edge resistance force on the fluke and soil resistance force on the shank during initial penetration. The anchor is, in consequence, longitudinally unstable during pulling, and rotates about the attachment point into a nose-down attitude wherein it fails to bury below the surface of the mooring bed or even breaks out of the soil altogether. A fluke angle of 32° or less has thus generally been adopted for the deepest burying anchors to permit effective use in both hard and soft soils. The resulting disadvantage in soft soils is usually mitigated by maximally increasing fluke area at the cost of reduced structural strength for hooking on rocks. However, even with increased fluke area, such anchors typically provide a soft mud performance less than 15 per cent of their sand performance. This illustrates the problem involved in providing an anchor with a single compromise fluke angle capable of producing high holding capacity in both hard sand and soft mud.

The applicant's European Patent No. 0180609 describes a marine anchor which, by the provision of a barrier plane aligned with transverse non-cohesive soil flow at the rear of the fluke and with a restriction passage between the barrier plate and the fluke, causes a stalled wedge of mud to accumulate on the fluke during burial in a soft mud bed. This mud wedge shears between the leading edges of the fluke and the upper edges of the barrier at an angle of 20° to the fluke (which is set at a fluke angle of 30° for sand) so that an effective fluke angle of 50° is established at the incident-mud/stalled-mud-wedge interface. This large effective fluke angle at the surface of the stalled wedge enables the anchor to operate satisfactorily in soft mud. In a sand bed, the restriction passage, although too small to permit a significant through-flow of cohesive soil (mud), allows escape of non-cohesive soil (sand) aft from over the fluke whereby shearing occurs at the fluke surface so permitting effective operation of the anchor in sand at the actual fluke angle of 30°. However, although this arrangement does provide improved capacity in mud, burial does not occur as deep as in the case of an anchor having a large fluke angle. Consequently, the very high holding capacity in soft mud of the deep based large fluke angle anchor is not achieved although the holding capacity does appreciably exceed that of the anchor with a small (sand) fluke angle When operating in mud. It is an object of the present invention to provide a marine anchor giving improved performance over the anchor of EP.0180609.

Another object of the present invention is to provide an improved marine anchor of the one-sided type (with the shank at one side only of the fluke) which self-orientates to a ground-engaging attitude when cast in an inverted position on and pulled horizontally over a mooring bed surface.

There can be problems in obtaining initial digging of an anchor in a hard clay bed, especially in the case of an anchor provided with means for self-orientating the anchor from an inverted position to a digging-in position, and it is a particular objective of the present invention to provide a marine anchor which obviates or mitigates this problem.

SUMMARY OF THE INVENTION

According to a first aspect of the present invention there is provided a marine anchor, symmetrical about a fore-and aft plane, including a basic anchor structure comprising a shank attached at a fluke angle θ to a fluke at one end and including an anchor line attachment point at the other end; a rear assembly including a plate-like surface support means for supporting the rear assembly so that the plate-like surface extends aft of the basic anchor structure for reaction with incident mooring-bed soil, the plate-like surface being upwardly inclined relative to the fluke thereby forming a forwardly and upwardly opening obtuse angle of inclination with the fluke, and soil escape passage means located between the fluke and the rear assembly, the rear assembly being arranged so that the plate-like surface in the anchor burying position presents a substantial forward component of area for substantial arrestment of soil impinging incident in the surface to provide in the plane of symmetry (M—M) a counter turning moment on the anchor about the anchor line attachment point which substantially counters opposing turning moments exerted on the anchor about the point due to pressure and friction of incident non-cohesive mooring bed soil on the shank and fluke during anchor burial in such soil, the soil escape passage means being dimensioned to permit free escape of both granular non-cohesive soils and soft mud cohesive soils passing over the fluke without causing the soft mud cohesive soils to be so retarded as to tend to accumulate over the fluke in advance of the rear assembly.

According to a second aspect of the present invention, there is provided a marine anchor, symmetrical about a fore-and aft plane, including a shank attachment at a fluke angle θ to a fluke at one end and including an anchor line attachment point at the other end; and a rear assembly comprising a plate-form structure including a plate-like surface extending aft of the fluke the plate-like surface in the anchor burying position presenting a substantial forward component of area for substantial arrestment of mooring-bed soil impinging incident on the surface, the plate-like surfaces being upwardly inclined relative to the fluke thereby forming a forwardly and upwardly opening obtuse angle of inclination with the fluke, the arrangement being such that when the anchor is upside-down in contact with a horizontal mooring bed surface with the plane of symmetry (M—M) vertical with the shank supported only just clear of the mooring bed by an anchor line attached at the attachment point, a point in the rear assembly makes contact with the mooring bed surface to support the anchor in an unstable position thereon, the rear assembly including peripheral edges which are curved to cause rolling of the anchor on the edges under gravity on toppling from the unstable position to bring the fluke into contact with the mooring bed surface.

According to a third aspect of the present invention there is provided a marine anchor symmetrical about a fore-and aft plane, comprising a shank attached at one end to a fluke so as to be located only at one side of the fluke and including an anchor-line attachment point at the other end, an upstanding toe at the front of the fluke which toe is upwardly inclined to an adjacent portion of the fluke at an obtuse angle less than 175° measured in planes parallel to the plane of symmetry, the toe having a bottom edge adapted for penetration of soil, means to orientate the anchor so that the anchor lies tilted on a mooring bed surface with the upstanding toe engaging the mooring bed surface, and means to support the anchor when in the tilted condition such that the anchor makes contact at three points comprising:

(A) A foremost end of the shank;

(B) The toe; and (C) A point on a rear part of the anchor, whereby the toe can penetrate the mooring bed prior to penetration of the mooring bed by the fluke.

An embodiment of the present invention will now be described by way of example with reference to the accompanying drawings wherein:

DESCRIPTION OF THE PREFERRED EMBODIMENTS

Figures 1, 4, 5, 7:
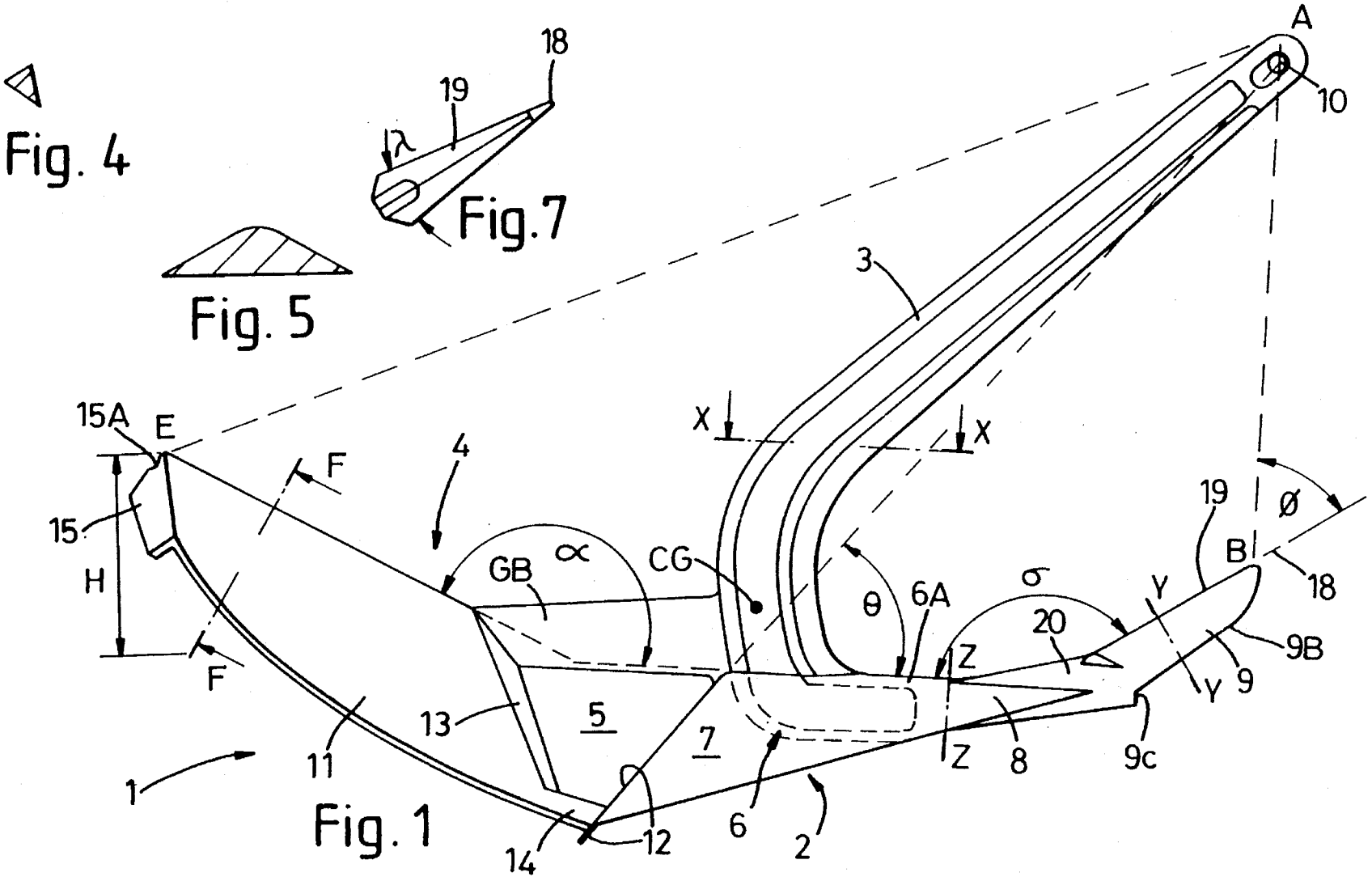
FIG. 1 is a side view of a marine anchor in accordance with a first embodiment of the present invention.
FIGS. 4, 5 and 6 show sections Y—Y, Z—Z and F—F respectively in FIG. 1.
FIG. 7 shows a toe portion of the fluke in FIG. 1 viewed normally to its upper surface.

Referring to FIGS. 1 to 7, a marine anchor 1 is symmetrical about a fore-and-aft plane M—M and comprises a fluke 2, a shank 3 attached at one end to the fluke 2, and including an anchor line attachment point 10 comprising a slotted hole at the shank end A remote, from the fluke 2, and a rear assembly 4 serving to counter moments of frictional forces and edge resistance on the fluke 2 and on the shank 3 about point 10, soil escape apertures 5 being located between fluke 2 and the rear assembly 4. More specifically, a base member 6 provides the shank 3 and includes arms 6A and 6B carrying tapered fluke plates 7 and the rear assembly 4 respectively, the arm 6A additionally providing a fluke forward portion 8 which forms a triangular fluke in conjunction with tapered fluke plate 7, and a toe portion 9 culminating in a point (B in FIGS. 1 and 10). The slotted hole at point 10 serves to receive a shackle for attachment of an anchor line.

The fluke angle θ is the angle between fluke 2 and a line in the plane of symmetry joining point 10 to the rear of fluke 2. Angle θ is shown as about 50° being in the preferred range of 32° to 58°..

The fluke 2 is of anhedral form with each fluke plate 7 having an anhedral angle β relative to a plane at right angles to the plane of symmetry and containing the intersection of plates 7. In this example, β is 29° but may be in the range 10° to 40°.

Figure 6:
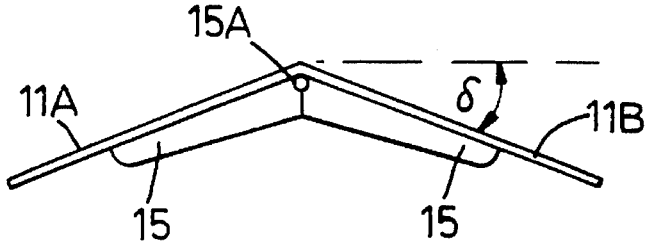

The rear assembly 4 is of plate form comprising a pair of plates 11 joined in the plane of symmetry so as to provide a backwardly directed shallow V in section and presenting two forwardly facing plate surfaces 11A, 11B constituting soil pressure reaction surfaces located aft of and extending over the full transverse span of aperture 5. As shown in FIG. 6, the V arranged plates are each inclined at an anhedral angle δ relative to a plane at right angles to the plane of symmetry and containing the intersection of surfaces 11A and 11B. Angle δ is shown as 22.5° being in a preferred range of 10° to 35°. The plate surfaces 11A, 11B intersect in a line forming a forwardly and upwardly directed obtuse angle α with the intersection line of plates 7 of fluke 2. The angle α represents the angle of inclination of the barrier 4 relative to the fluke 2. Angle α is shown as 155° being in the preferred range of 120° to 170°. Consequently the intersecting line of plates 11A, 11B can form an obtuse angle in the range 90° to 145° with the line from the shackle point 12 to the rear of the fluke.

The rear of fluke 2 is strengthened by an inclined lower transverse rib plate 12 which lies in a plane which has minimum separation from point 10 aft and above point 10. When projected in the direction of the intersection of plates 7 with the plane of symmetry, the area of rib plate 12 is approximately half of the area of assembly 4 (FIG. 3), specifically, 0.2 to 0.7 times the area of the upwardly-facing plate-like surfaces 7 of the fluke 2, and so contributes approximately one third of the total resistance area of the anchor when fully buried in mud.

The rear assembly also includes forward transverse strengthening rib plate 13 formed at the forward edges of plates 11, and aft transverse stiffening rib plates 15 formed with anhedral between them at the rear edges of plates 11. Fluke extension plates 14 between the assembly 4 and the fluke 2 flank the apertures 5 and serve to extend the peripheral edges of plates 11 to the transverse extremities of fluke 2 to prevent chains, ropes and the like from entering and jamming in the apertures 5. The rib plates 15 carry between them an eye 15A to which a pendant line may be secured for retrieval of the anchor.

Figure 10:
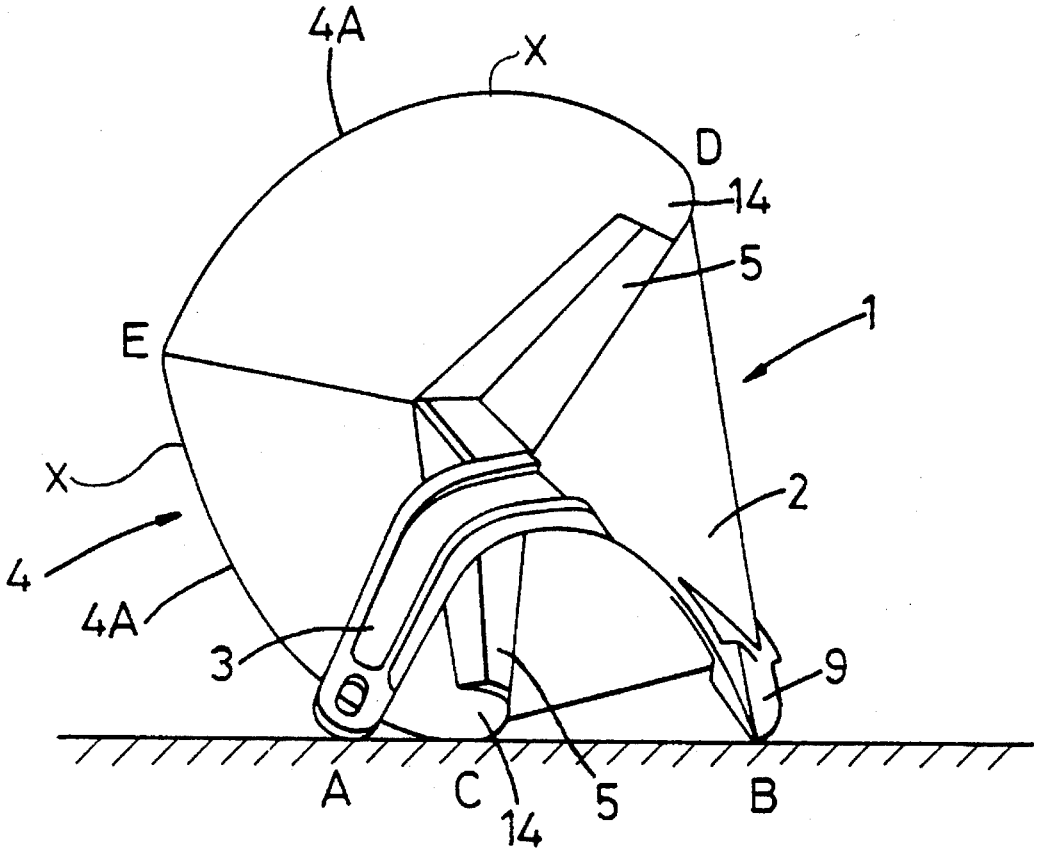
FIG. 10 shows a pictorial view of the anchor of FIGS. 1 to 7 in a mooring bed engaging position with the fluke point ready to engage the soil.

The anchor 1 is self-orientating and to this end the peripheral edge 4A of the assembly 4 is of cardioidal shape to cause rolling of the anchor 1 from an inverted position to a mooring bed engaging position as shown in FIG. 10. When the anchor 1 is placed inverted on a horizontal plane surface of a film mooring bed contact will be made substantially only at the top E of the assembly 4 and at forward point A on the shank. Only points X on the curves EC or ED and points at A and B make contact with the horizontal surface of the mooring bed when the anchor 1 is pulled thereover by pulling at the shackle point 10 at the end A of the shank 3.

Curves EC and ED in periphery 4A each lies substantially in a skewed axis elliptical conical surface with the apex of the cone adjacent the shackle end (A) of the shank 3, the skewed axis of the cone intersecting the plane of symmetry at a point, with the minor axis of the elliptical cross-section of the cone lying athwart the plane of symmetry of the anchor, and with the major axis of cross-sections of the cone lying in the plane of symmetry. Thus, each of curves EC and ED constitutes a spiral curve relative to the center of gravity CG (FIG. 1) of anchor 1.

As the anchor topples from an inverted position, a vertical plane is present through the two contact points X, A of the anchor with the mooring bed surface supporting the anchor, and the anchor rolling is effected by virtue of the peripheral curved edges 4A of the rear assembly 4 being arranged such that the center of gravity C G of the anchor is kept spaced from the side of the vertical plane facing the fluke point B whereby a transverse turning movement due to gravity is maintained which progressively rolls the anchor round one peripheral curved edge 4A until the fluke point B is brought into penetrative engagement with the mooring bed surface.

Further, the peripheral edges 4A at either side of the plane of symmetry (M—M) form a substantially spiral curve relative to the center of gravity of the anchor wherein points X on the peripheral edges 4A distal to the fluke 2 are further from the center of gravity CG than points X on the edges proximal to the fluke 2.

Consequently, in the inverted position, the center of gravity CG (FIG. 1) of the anchor is high above the line containing the support points at A and E. The anchor is thus unstable in the inverted position and so quickly topples to one side of a vertical plane through A and E. The contact point at E migrates along EC or ED as a moving contact point X. The skewed-axis nature of the conical surface, in which each spiral curve EC or ED lies, maintains a horizontal displacement of the center of gravity CG from one side of a vertical plane through A and X and so maintains a gravitational transverse turning moment which rolls the anchor along periphery 4A until the point of the toe portion 9 of the fluke 2 is brought into penetrative contact with the mooring bed surface (Point B in FIG. 10). The anchor is now in one of two possible stable positions one of which is shown in FIG. 10. In this stable position, three-point contact is present with either left-hand fluke extension 14 or right-hand fluke extension 14 in contact with the mooring bed surface.

The shank 3 is of a partially straight form with its center-line substantially separated from line AE so that the mass of the shank contributes considerably to the gravitational rolling moment which turns the anchor into penetrative engagement with the mooring bed. Also, the substantial concavity between line AE and the anchor, achieved by this location of the shank, precludes serious obstruction to the rolling action.

The toe portion 9 which is of robust solid form upwardly inclined to form a rearwardly-directed obtuse angle $\sigma$ between its upper surface and the intersection line between plates 7 of fluke 2. Angle $\sigma$ is shown as 146° being in a preferred range of 130° to 175°. The adjacent fluke portion 8 is also of robust solid form with a generally triangular cross-section as shown in FIG. 5. Portion 8 serves as a ballast weight and as a strong support for the forward edges of plates 7 capable of sustaining the high pressure loading occurring on the fluke of the anchor 1 when burying in firm to hard mooring beds. The toe portion 9 is a forward portion of arm 6A formed to constitute a small auxiliary triangular fluke of generally arrow or spear head form which precedes the main fluke comprising plates 7 and portion 8. This auxiliary fluke has a rearward major upper surface 19 and a forward minor upper surface 18 inclined relative to each other. The rearward major upper surface 19 forms an external angle $\Phi$ with a line joining point 10 in the shank 3 to a foremost point of surface 19 in the plane of symmetry. Angle $\Phi$ is shown as 56° being in the preferred range of 50° to 65° and less than 70°.

The upper major surface 19 in the view normal to the surface shown in FIG. 7 is generally of elongate triangular shape with the sharp apex forward and the side edges including an angle $\lambda$. Angle $\lambda$ is shown as 18°, being in a preferred range of 10° to 30°. The minor upper surface 18 is less than 5 per cent of the area of surface 19 and is located in a plane at right angles to the line joining point 10 in the shank to a foremost point of surface 19 in the plane of symmetry. This surface 18 serves to provide sufficient bearing area at the point of toe 9 to sustain a point load of 71 times anchor weight without bearing failure occurring whilst remaining sufficiently small to avoid preventing penetration of the point of toe 9 into very hard mooring bed surfaces such as firm clay.

A typical substantially triangular section through the toe portion 9 is shown in FIG. 4. The lower apex of the section corresponds with a sabre-like lower edge 9B of toe portion 9. A step 9C is present in edge 9B. This acts as a tripping fulcrum which prevents skidding of edge 9B on stiff clay and trips anchor 1 to topple sideways to bring the point of toe 9 into engagement with the stiff clay. The upper major surface 19 may be planar or of anhedral form like fluke 2. Each section of toe 9 has sufficient depth and area to sustain the bending moment and shear force due to a substantial point load, and in particular a point load 71 times anchor weight applied at the junction between major upper surface 19 and minor upper surface 18. The sabre-like lower edge of toe portion 9 is provided to cleave the mooring bed soil with minimum resistance when the anchor is deeply buried with the incident relative soil flow occurring in the direction of arrow EF in FIG. 9.

Passages 20 are present between the solid auxiliary fluke of toe portion 9 and fluke forward portion 8. These passages 20 increase in transverse cross-sectional area in an afterwards direction to promote free transit of mooring bed soil there-through without jamming. The inclined length of toe portion 9 co-operates with the fluke extensions 14 to keep the edge of fluke plate 7 raised clear of the mooring bed surface when the anchor is in three point contact with the mooring bed surface as shown in FIG. 10. This permits the auxiliary fluke of toe portion 9 to penetrate fully into a firm or hard mooring bed surface before edge resistance from fluke portion 8 and plate 7 arises on contacting the surface.

The rear assembly 4 enables the anchor 1 to bury deeply in sand even when the fluke angle $\theta$ has a relatively high value exceeding 32°, and in this connection the plates 11A, 11B aft of aperture 5 define a barrier to sand flow.

Figure 8:
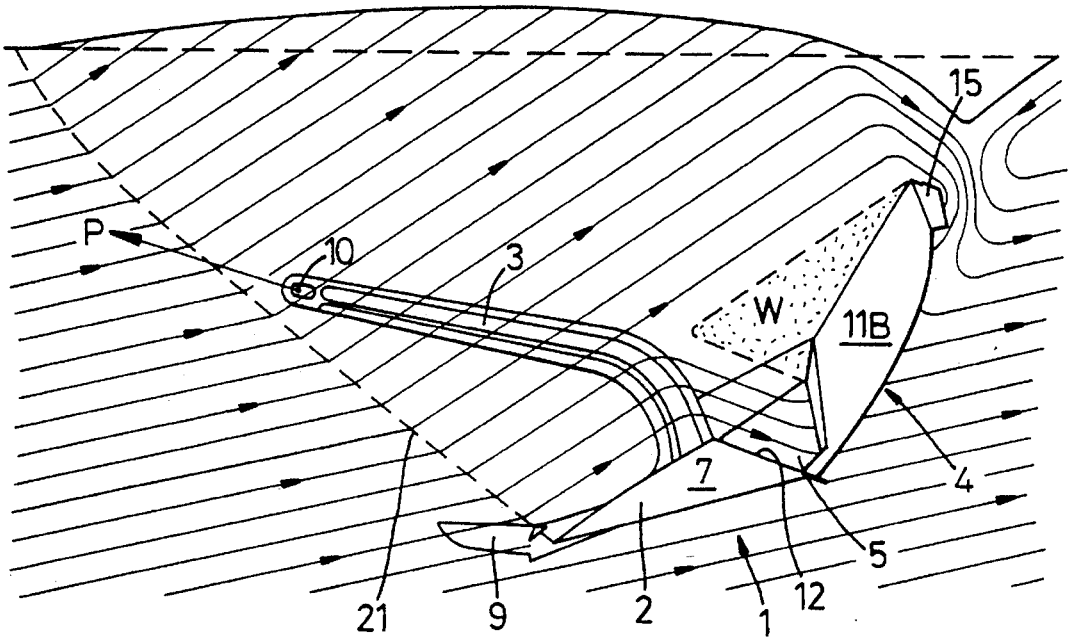
FIG. 8 shows the sand flow paths over the anchor while burying deeply in sand due to a forward pull P applied to the anchor.

FIG. 8 shows (arrowed) relative movement flow lines of sand over and about a moving buried anchor 1 adjacent is plane of symmetry. The flowing sand changes direction due up interaction with fluke 2 and shears along planes 21 emanating from the edges of fluke 2. Following shearing, the flow is generally parallel to plates 7 of fluke 2 with parting of the flow occurring about stalled sand wedge W which forms on the faces 11A, 11B of the barrier assembly 4. One part of the sand flow slides over an upper surface of wedge W which is substantially aligned with the sand flow and another part flows over rib plate 12 and under a lower surface of wedge W before exiting aft through soil escape apertures 5 to fill a void tending to form continuously behind the fluke. Sand flow overtopping barrier 4 cascades downwards to fill a void tending to form continuously behind the barrier.

Figure 2:
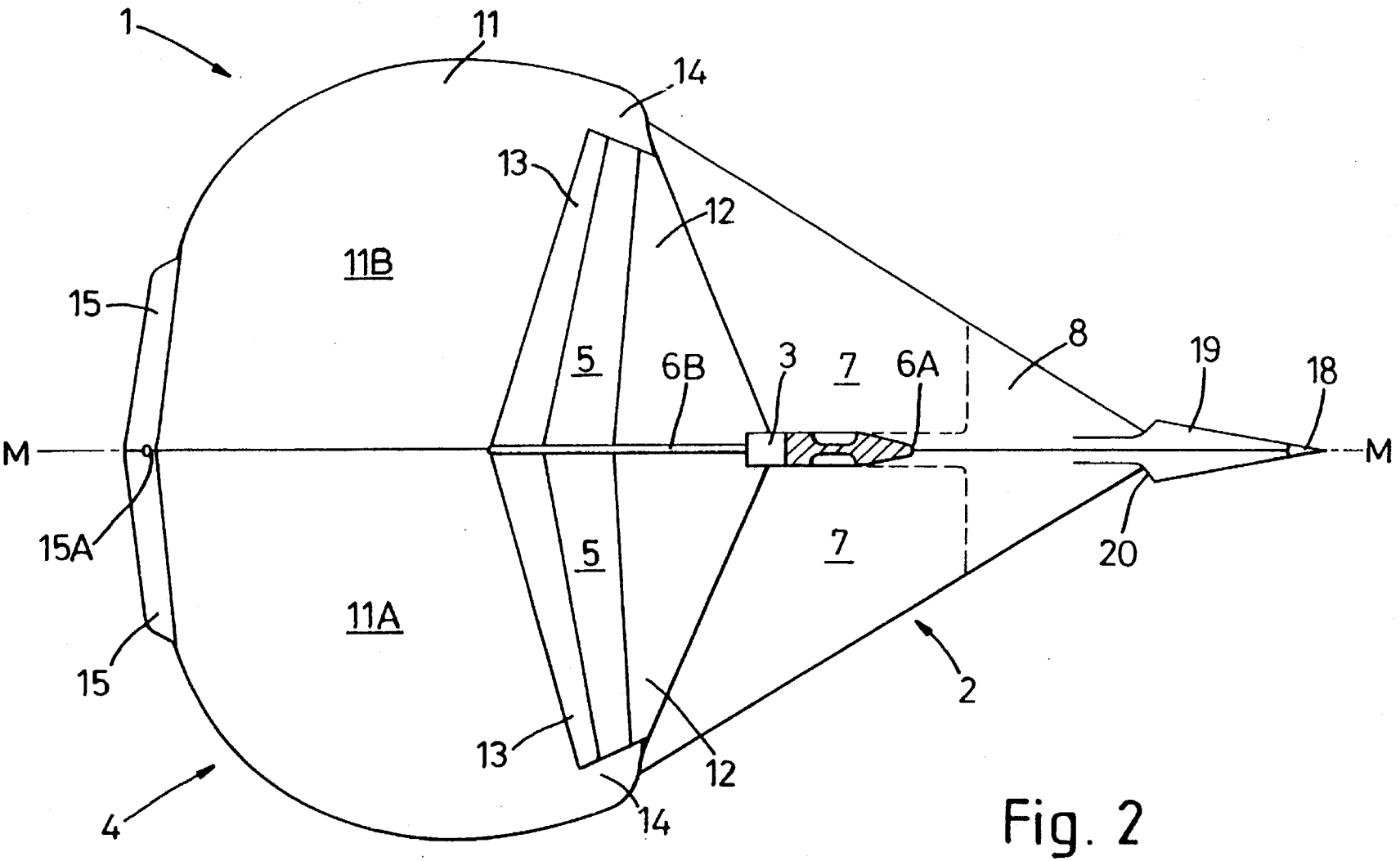
FIG. 2 is a plan view through section X—X in FIG. 1.
Figure 3:
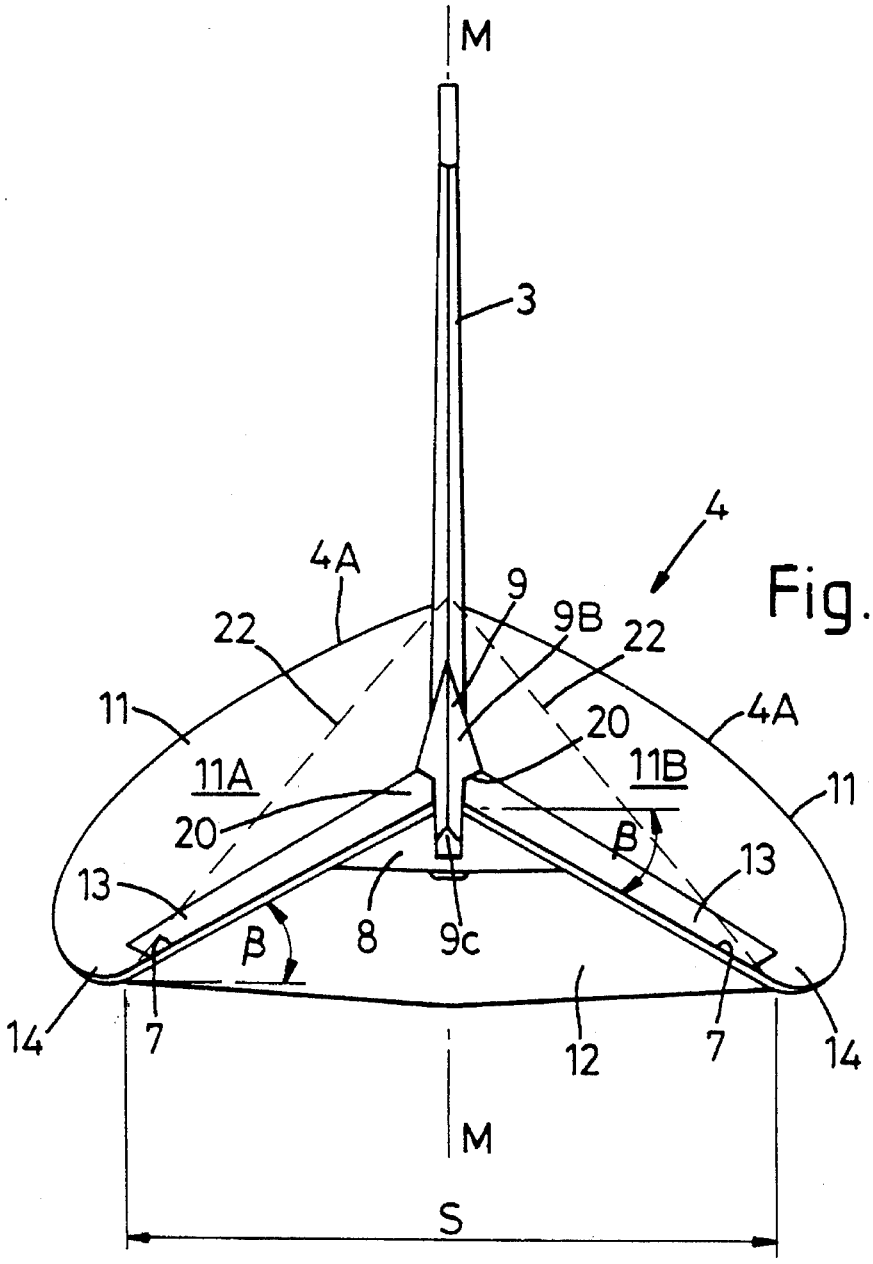
FIG. 3 is a front view of the anchor.

The stalled wedge W moves with the anchor and effectively forms part of the anchor when operating in sand. Sand pressure and movement at the surface of wedge W produces normal tangential forces which are transmitted through the body of the wedge onto the forward facing surface 11A, 11B of the barrier. The surface area and shape of the wedge W and, hence, the size and direction of the resultant force applied to the barrier depends on the inclination angle $\alpha$ and the area of the barrier. For a given area of barrier, the angle $\alpha$ determines the position and direction of the resultant force $R_W$ on the upper surface of wedge W riding on faces 11A, 11B of the barrier and, hence the magnitude of the turning moment produced by RW about shackle point 10. This desirable turning moment is appreciable when $\alpha$ is in the range 130° to 165° and reaches a peak when $\alpha$ is between 145° and 155°. The area of barrier 4, when viewed in the plane of symmetry at right angles to the intersection line of surfaces 11A and 11B, lies in the range 0.8 to 2.2 times the area of fluke 2 viewed in the plane of symmetry at right angles to the intersection of plates 7, with the optimum area being between 1.5 and 1.9 times the area of fluke 2 when $\alpha$ is between 140° and 160°. Since there is no need to minimize the size of apertures 5 to constitute a choke gap for restricting through flow of mud to produce a stalled mud wedge on the fluke when the anchor is operating in a mud mooring bed, the width of apertures 5 measured in a plane parallel to the plane of symmetry can be in the range 10 to 70 per cent of the length of the intercept of the upper surfaces of fluke 2 in the plane of symmetry. FIGS. 1–3 show a width of 43 per cent which corresponds to a sand flow cross section area in each aperture 5 equal to the area of a triangle at either side of the plane of symmetry of anchor 1, seen in front elevation (FIG. 3), bounded by plate 7 and a line 22 joining the outer extremity of plate 7 to the uppermost point in barrier 4. This area equals one quarter of the area obtained by multiplying the span (S) of fluke 2 by the distance (H) separating an uppermost point in the rear assembly 4 from a straight line containing the intersection of the upper surface of the fluke 2 with the plane of symmetry. This ensures that sufficient sand discharges through apertures 5 to maintain the flow regime shown in FIG. 8 and prevent sand wedge W from bridging between the outer edges of barrier 4 and fluke 2 thus increasing the effective fluke angle high enough to prevent deep burial of anchor 1 in sand.

Figure 9:
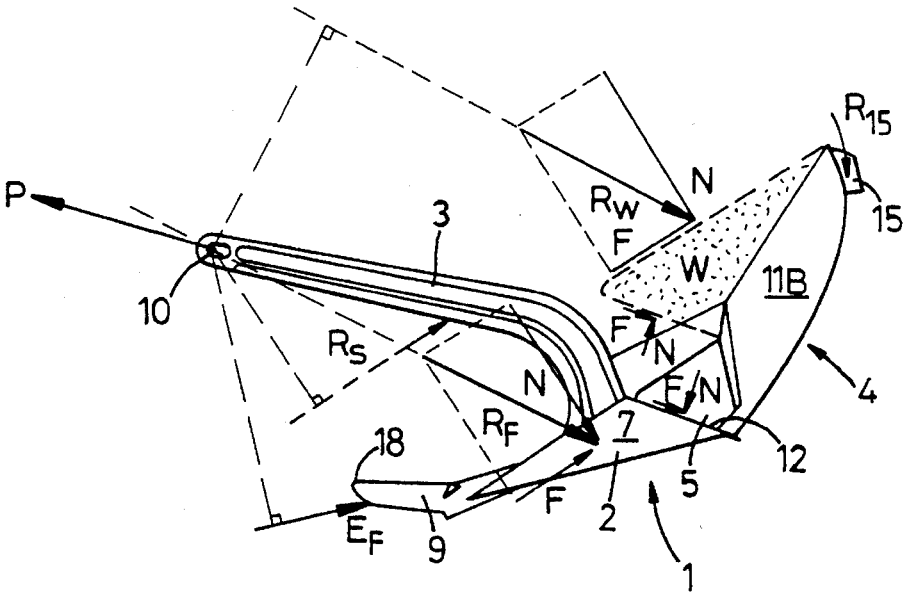
FIG. 9 shows the various forces and turning moments on the anchor when it is burying in a sand mooring bed as shown in FIG. 8.

FIG. 9 shows the force vectors and moments developed on the buried anchor due to the sand flow pattern shown in FIG. 8. Friction forces tangential to surfaces are labelled F and normal pressure forces at right angles to these surfaces are labelled N. Resultant force vectors due to F and N are labelled R with subscripts F, S, W, and 15, denoting forces associated with the fluke, shank, wedge W upper surface, and ribs 15. For clarity, resultant forces on rib plate 12 and the under surface of wedge W have not been shown since the opposed normal forces on these surfaces largely cancel out leaving the sum of the tangential friction forces as the combined resultant force. $E_F$ is shown as a vector representing the edge resistance force on the fluke structure.

With assembly 4 removed from anchor 1, the clockwise turning moments due to tangential and normal forces on plate 12, in the presence of zero turning moment from $R_F$, are too small to balance the anti-clockwise turning moments produced by $R_S$ and $E_F$. Additionally, $E_F$ is particularly large in dense sand since it is produced at the edges of fluke 2 and toe portion 9 before the sand is loosened by passage through shear planes 21 (FIG. 8). A net anti-clockwise turning moment would thus be present which would tip up the rear of fluke 2 and decrease the vertical components of forces on plates 7 and 12 so preventing the anchor from burying deeply. As in prior art anchors, this can be avoided by arranging the direction of $R_F$ to pass with sufficient clearance above shackle point 10 to produce a balancing clockwise turning moment. In dense sand, reduction of fluke angle $\theta$ from the 52° shown in FIG. 1 to 30° or less would thus be necessary.

With the barrier assembly 4 now installed on anchor 1 at an angle $\alpha$ of 155°, forces due to pressure and movement of sand on ribs 15 and on the stalled sand wedge W at the face of barrier 4 are developed. The resultant force $R_{15}$ on rib plates 15 is small but produces an appreciable clockwise turning moment due to the large separation of its line of action from shackle point 10. The normal force on the lower surface of wedge W cancels with the normal force on plate 12 leaving the corresponding friction forces acting together to produce a clockwise turning moment about shackle point 10. The large resultant force $R_W$ at the upper surface of wedge W lies in a direction having a large separation from shackle point 10 and so produces a major clockwise turning moment. The sum of these clockwise turning moments is sufficient to balance the combined anti-clockwise turning moments produced by $R_S$ and $E_F$ without help from a clockwise moment from $R_F$ which would require a reduction in fluke angle $\phi$ from values considered by convectional wisdom as too large for effective burying in dense sand. This arrangement of barrier 4 and apertures 5 can thus be utilized to provide an anchor capable of burying deeply in dense sand while using a fluke angle much larger than hitherto possible. This large fluke angle is then well suited for efficient operation of the anchor in soft mud. This arrangement of barrier 4 and apertures 5 permits an anchor with a fixed fluke angle as high as 52° to equal its mud performance when operating in dense sand without the traditional necessity of reducing the fluke angle to 30° or less.

In use, an anchor 1, with a fluke angle $\theta$ of 52° as shown in FIGS. 1 to 10, may be cast inverted on a mooring bed surface and dragged by a horizontal pull applied to the shackle point 10 of the shank 3.

On a firm mooring bed surface, the anchor will topple about line AE (FIG. 1) to one side and will then rapidly roll on periphery 4A until it is in three-point contact with the mooring bed as shown in FIG. 10.

On a soft mud mooring bed, the inverted anchor will sink into the soft surface under its own weight. Penetration will occur mainly at the rear barrier assembly 4 in the region of point E (FIG. 1) but is kept small due to the support provided by the area of ribs 15 bearing on the mud. Forward motion causes the barrier plates to plane and rise towards the surface of the mud. Instability in this inverted position due to the anhedral between ribs 15 and between plates 11 at the inverted peak of the barrier 4, the curved periphery 4A, and the elevated position of the center of gravity CG initiates rolling which continues until three-point contact on the soft mud surface is achieved (in effect) as in the case of the firm mooring bed.

Further dragging causes toe 9 to penetrate into the mooring bed where soil pressure on the obliquely presented uppermost side face of toe 9 causes it to dig in sideways under the anchor. Simultaneously, soil pressure on the major upper surface 19 of toe 9 causes it to bury completely into the mooring bed and start portion 8 of fluke 2 digging also. The sideways force on toe 9 acts to initiate rolling of the anchor as burial of fluke 2 proceeds. The extension plate 14, in contact with the soil at one side of anchor 1, develops sufficient resistance force to act as a fulcrum about which the burial force on fluke 2 now acts to roll the anchor to the final upright digging attitude with the plane of symmetry M—M (FIGS. 2 and 3) vertical.

In sand, the relative soil flow pattern shown in FIG. 8 develops during burying and longitudinally stabilizes the anchor as shown in FIG. 9 and described previously. In mud, the soil flows up and over the fluke and up and over the barrier without forming a stalled wedge of mud on the fluke in advance of the barrier. Sliding of the soil occurs at the fluke surface both in sand and in mud but since the fluke angle is large, deep penetration and consequent high performance is achieved in mud as well as in sand.

When burying deeply in mud the intersection in the plane of symmetry of fluke plates 7 of anchor 1 ultimately becomes approximately horizontal with the mud flowing edge on to plates 7 as viewed in FIG. 3. In this attitude, the barrier 4 and rib plate 12 provide a major part of the horizontally-projected area of the anchor and, hence, the major part of its holding capacity. The combination of large fluke angle and large barrier counter moment in anchor 1 causes it to bury deeply in sand despite the presence of the larger fluke angle necessary for optimum performance in mud. In sand, the fluke 2 produces the major portion of the ultimate holding capacity although a substantial contribution does come from sand pressure on the barrier. Thus, the turning moment from the barrier allows fluke 2, inclined at a very large fluke angle in anchor 1 to provide high capacity in sand.

If the anchor 1 is cast on a hard rocky bottom, gravitational rolling to the three-point contact attitude of FIG. 10 occurs as before. Horizontal dragging causes toe 9 to track along the rocky surface and hook into any crevice or onto any projection in its path. The only possible location on anchor 1 at which rock hooking engagement can occur is at the point of toe 9 on minor upper surface 18 which, as mentioned before, can be designed to sustain a load of 71 times the weight of the anchor. Since the rock hooking load line between shackle point 10 and the upper minor surface 18 lies in the plane of symmetry M—M of anchor 1, no out-of-plane bending moments are impressed on shank 3. Consequently, the shank 3 may advantageously be of simple design and of relatively thin sections so minimizing the resistance force $R_S$ and minimizing the weight of the shank.

The present invention discloses an anchor which is self-righting and which can provide high holding capacity exceeding 71 times its own weight in both firm sand and soft mud without need of fluke angle adjustment and which can sustain a load exceeding 71 times its own weight applied at the extreme forward point of its fluke due to hooking on rocks. This combination of features has not hitherto been available in marine anchors.

Modifications, of course, are possible. In particular it would be possible to have the anchor dismantlable to facilitate stowage, shipping etc. For example the rear assembly 4 could be removably fastened to the remainder of the anchor, and if desired this removable portion could include the arm 6B. Fastening could be achieved by the use of bolts suitably positioned to accommodate the load stressing on the in-use anchor. It would be possible to stow the removed portion in the space between the shank 3 and the fluke 2.

Also, in some inventive aspects the soil passage may be dispensed with.

I claim:

1. A marine anchor, symmetrical about a fore-and aft plane, including a basic anchor structure comprising:

a fluke;

a shank having a first end and second end, said shank being attached at a fluke angle θ to said fluke at said first end and including an anchor line attachment point at said second end;

a rear assembly including a plate-like surface;

means for supporting said rear assembly so that said plate-like surface extends aft of said basic anchor structure for reaction with incident mooring-bed soil, said plate-like surface being upwardly inclined relative to said fluke thereby forming a forwardly and upwardly opening obtuse angle of inclination with said fluke; and soil escape passage means located between said fluke and said rear assembly, said rear assembly being arranged so that said plate-like surface in the anchor burying position presents a substantial forward component of area for substantial arrestment of soil impinging incident on the surface to provide in the plane of symmetry (M—M) a counter turning moment on said anchor about said anchor line attachment point which substantially counters opposing turning moments exerted on said anchor about said point due to pressure and friction of incident non-cohesive mooring bed soil on said shank and fluke during anchor burial in such soil, said soil escape passage means being dimensioned to permit free escape of both granular non-cohesive soils and soft mud cohesive soils passing over the fluke without causing said soft mud cohesive soils to be so retarded as to tend to accumulate over said fluke in advance of said rear assembly.

2. An anchor according to claim 1, wherein the fluke angle θ exceeds 32°.

3. An anchor according to claim 2, Wherein the fluke angle θ is in the range 32° to 58°.

4. An anchor according to claim 1, wherein the periphery of said rear assembly is shaped to assist rolling of said anchor to a position, wherein said fluke engages the mooring bed.

5. An anchor according to claim 1, wherein said fluke has a front end, and wherein an upturned toe member is provided at said front end of said fluke.

6. An anchor according to claim 5, wherein said toe member has a general triangular cross-section.

7. An anchor according to claim 1, wherein said fluke is of anhedral form with an anhedral angle β.

8. An anchor according to claim 7, wherein the anhedral angle β is in the range 10° to 40°.

9. An anchor according to claim 1, wherein said obtuse angle of inclination is in the range 120° to 170°.

10. An anchor according to claim 1, wherein said rear assembly includes a pair of said plate-like surfaces, and wherein the intercept of said plate-like surfaces of said rear assembly with the plane of symmetry (M—M) forms an upwardly-opening obtuse angle with a line in the plane of symmetry joining said anchor line attachment point to the rear of said fluke.

11. An anchor according to claim 10, wherein said upwardly-opening obtuse angle is in the range 90° to 145°.

12. An anchor according to claim 1, wherein said shank is attached to said fluke at one side only of said fluke.

13. An anchor according to claim 1, wherein said rear assembly comprises a transverse plate structure which extends through the plane of symmetry (M—M).

14. An anchor according to claim 1, wherein said rear assembly includes a pair of said plate-like surfaces, said plate-like surfaces being forwardly-facing and intersecting in the plane of symmetry (M—M) and each backwardly inclined at an angle of anhedral δ relative to a plane at right angles to the plane of symmetry (M—M) containing the intersection of said surfaces.

15. An anchor according to claim 14, wherein said anhedral angle δ is in the range 10° to 35°.

16. An anchor according to claim 1, wherein said soil escape passage means comprises an aperture between said rear assembly and said fluke extending over at least a quarter of the transverse width of said anchor fluke astride the plane of symmetry.

17. An anchor according to claim 1, wherein the separation between said rear assembly and said fluke in the plane of symmetry (M—M) exceeds 10 per cent of the length of the intercept of said fluke with the plane of symmetry (M—M).

18. An anchor according to claim 1, wherein the separation between said rear assembly and said fluke in the plane of symmetry (M—M) exceeds 20 per cent of the length of the intercept of said fluke with the plane of symmetry (M—M).

19. An anchor according to claim 1, wherein said rear assembly includes a pair of said plate-like surfaces, and wherein the projected area of said plate-like surfaces of said rear assembly in a plane at right angles to the plane of symmetry (M—M) containing the intercept of said plate-like surface with the plane of symmetry is in the range of 0.8 to 2.2 times the projected area of said fluke projected onto a plane at right angles to the plane of symmetry (M—M) containing the intercept of said fluke with the plane of symmetry.

20. An anchor according to claim 1, further comprising side plate members extending between said fluke and said rear assembly and flanking said soil escape passage means.

21. An anchor according to claim 1, wherein said anchor includes a base member comprising said shank and a pair of support arms to respective ones of which arms said fluke and said rear assembly are attached.

22. An anchor according to claim 1, wherein the total soil passage area of said soil escape passage means is not less than one quarter of the calculated area obtained by multiplying the span (S) of said fluke by the distance (H) separating an uppermost point in said rear assembly from a straight line containing the intersection of the upper surface of said fluke with the plane of symmetry.

23. An anchor according to claim 1, further comprising a transverse stiffening rib located adjacent the upper edge of said rear assembly serving as a support footing when said anchor is inverted on a soft mud mooring bed.

24. An anchor according to claim 1, wherein said rear assembly includes a pair of said plate-like surfaces, said plate-like surfaces being forwardly facing, and further comprising a transverse stiffening rib located adjacent the lowermost forward edges of said forwardly facing plate-like surfaces on said rear assembly.

25. An anchor according to claim 1, wherein said fluke includes a pair of upwardly-facing, plate-like surfaces and a transverse stiffening rib located under the rear of said upwardly-facing plate-like surfaces of said fluke, said upwardly-facing plate-like surfaces of said fluke serving also as a barrier to movement of soft cohesive soil passing closely under the fluke.

26. An anchor according to claim 25, wherein said fluke transverse rib is located in a plane which contains the rear edges of said upwardly-facing plate-like surfaces of said fluke and extends substantially in the direction of said anchor line attachment point.

27. An anchor according to claim 26, wherein the area of said fluke transverse rib is in the range 0.2 to 0.7 times the area of said upwardly-facing plate-like surfaces of said fluke.

28. A marine anchor, symmetrical about a fore-and aft plane, including:

a fluke having a fluke point;

a shank having a first end and second end, said shank being attached at a fluke angle θ to said fluke at said first end and including an anchor line attachment point at said second end; and a rear assembly comprising a plate-form structure including a plate-like surface extending aft of said fluke, said plate-like surface in the anchor burying position presenting a substantial forward component of area for substantial arrestment of mooring-bed soil impinging incident on the surface, said plate-like surface being upwardly inclined relative to said fluke thereby forming a forwardly and upwardly opening obtuse angle of inclination with said fluke, the arrangement being such that when said anchor is upside-down in contact with a horizontal mooring bed surface with said plane of symmetry (M—M) vertical with said shank supported only just clear of the mooring bed by an anchor line attached at said attachment point, a point in said rear assembly makes contact with the mooring bed surface to support said anchor in an unstable position thereon, said rear assembly including peripheral edges which are curved to cause rolling of said anchor on: said edges under gravity on toppling from said unstable position to bring said fluke into contact with the mooring bed surface.

29. An anchor according to claim 28, wherein when rolling from an inverted position while supported by a hard horizontal mooring bed surface, said anchor can make contact with the mooring bed at only two points, being a point on said peripheral edge and a point on said shank adjacent said anchor line attachment point until the foremost point of said fluke makes penetrative contact with the mooring bed whereupon three contact points are established.

30. An anchor according to claim 28, wherein said curved peripheral edges are of cardioidal form with the apex of the cardioid uppermost.

31. An anchor according to claim 28, wherein said peripheral edges at one side of said plane of symmetry (M—M) lie in an elliptical conical surface with the apex Of the cone adjacent said anchor line attachment point of said shank and with the major axis of a cross-section of the cone lying in said plane of symmetry (M—M).

32. An anchor according to claim 28, wherein the peripheral curved edges of said rear assembly are arranged such that the center of gravity of said anchor is kept spaced from the side facing the fluke point of a vertical plane through the two contact points between said anchor and a horizontal mooring bed surface supporting it as it topples from an inverted position whereby a transverse turning movement due to gravity is maintained which progressively rolls said anchor round the peripheral curved edge until said fluke point is brought into penetrative engagement with the mooring bed surface.

33. An anchor according to claim 28, wherein said peripheral edges at either side of said plane of symmetry (M—M) form a substantially spiral curve relative to the center of gravity of said anchor wherein points on said peripheral edges distal to said fluke are further from said center of gravity than points on said edges proximal to said fluke.

34. An anchor according to claim 28, wherein said fluke is of anhedral form with an anhedral angle $\beta$.

35. An anchor according to claim 28, wherein said rear assembly includes a pair of forwardly-facing plate-like surfaces intersecting in the plane of symmetry (M—M) and each backwardly inclined at an angle of anhedral $\delta$ relative to a plane at right angles to the plane of symmetry (M—M) containing the intersection of the surfaces.

36. A marine anchor symmetrical about a fore-and aft plane, comprising:

a main fluke, said main fluke having a front and an upstanding toe at said front, said toe being upwardly inclined to an adjacent more rearward portion of said main fluke at an obtuse angle $\sigma$ less than 175° measured in planes parallel to the plane of symmetry, said toe having a bottom edge adapted for penetration of soil;

a shank having a first end and second end, said shank being attached at said first end to said main fluke so as to be located only at one side of said main fluke and including at said second end an anchor-line attachment point;

means to orientate said anchor so that said anchor lies tilted on a mooring bed surface with said upstanding toe engaging the mooring bed surface; and means to support said anchor when in said tilted condition such that said anchor makes contact with the mooring bed surface at three points comprising:

(A) a foremost end of said shank;

(B) said toe; and (C) a point on a rear part of the anchor, whereby said toe can penetrate the mooring bed prior to penetration of the mooring bed by said main fluke.

37. An anchor according to claim 36 wherein said obtuse angle $\sigma$ is in the range of 130° to 175°.

38. An anchor according to claim 36 wherein intersection lines between planes parallel to the plane of symmetry (M—M) and a major upper surface of said toe each form an acute angle $\Phi$ with a plane at right angles to the plane of symmetry (M—M) which contains the anchor line attachment point in said shank and a foremost point in said major upper surface.

39. An anchor according to claim 38, wherein said angle $\Phi$ is less than 70°.

40. An anchor according to claim 38, wherein said acute angle $\Phi$ lies in the range 50° to 70°.

41. An anchor according to claim 38, wherein said toe has a minor upper surface forward of and inclined to said major upper surface and facing said anchor line attachment point.

42. An anchor according to claim 41, wherein said minor upper surface is substantially at right angles to said line containing said anchor line attachment point and the foremost point (B) in the major upper surface of said toe.

43. An anchor according to claim 36, wherein the lower periphery of said toe comprises a sabre-like edge to cleave mooring bed material.

44. An anchor according to claim 43, wherein said lower periphery of said toe includes a tripping barb about which said anchor can topple to bring a foremost point in said toe into penetrative contact with the mooring bed surface following penetration Of said surface by said barb.

45. An anchor according to claim 36, wherein said toe is of substantially solid form with substantially triangular cross-sections, each cross-section having a lowermost apex located in the plane of symmetry (M—M).

46. An anchor according to claim 36, wherein said toe when viewed in blan is of pointed form similar to arrow and spear points, to promote penetration of firm mooring beds.

47. An anchor according to claim 36, wherein said toe constitutes a forward auxiliary fluke preceding said main fluke.

48. An anchor according to claim 47, further comprising an arm member upstanding from said main fluke, wherein said forward auxiliary fluke is carried on said arm member.

49. An anchor according to claim 48, wherein passages are located at each side of said arm member between said forward auxiliary fluke and said anchor main fluke.

50. An anchor according to claim 49, wherein said passages are rearwardly divergent to promote soil flow therethrough.

51. An anchor according to claim 36, further comprising an anchor base member, and wherein said anchor base member includes said shank and said toe, said base member carrying fluke plate portions arranged in anhedral form to constitute said main fluke.

* * * * *

UNITED STATES PATENT AND TRADEMARK OFFICE

CERTIFICATE OF CORRECTION

PATENT NO : 5,511,506

DATED : April 30, 1996

INVENTOR(S) : BRUCE

It is certified that error appears in the above-identified patent and that said Letters Patent is hereby corrected as shown below:

Title page, item [57],

In the Abstract:

Line 8, insert --a-- between "while" and "soil"; and delete "escapes the" and insert in place thereof --escape--.

In the Specification:

Column 2, line 9, delete "based" and insert in place thereof --buried--.

Column 2, line 12, delete "When" and insert in place thereof --when--.

Column 2, line 47, delete "in the surface" and insert in place thereof --on the surface--.

Column 3, line 7, insert --and-- between "vertical" and "with".

Column 5, line 2, delete "film" and insert in place thereof --firm--.

Column 5, line 21, delete "and the anchor" and insert in place thereof --and anchor--.

Column 6, lines 12 and 14, delete "angle $\Phi$" and insert in place thereof --angle $\phi$--.

Column 6, third to last line, delete "is" and insert in place thereof --its--.

Column 6, last line, delete "up" and insert in place thereof --to--.

UNITED STATES PATENT AND TRADEMARK OFFICE

CERTIFICATE OF CORRECTION

PATENT NO : 5,511,506

DATED : April 30, 1996

INVENTOR(S) : BRUCE

It is certified that error appears in the above-identified patent and that said Letters Patent is hereby corrected as shown below:

Column 7, line 16, insert --and-- between "normal" and "tangential".

Column 8, line 38, delete "convectional" and insert in place thereof --conventional--.

Column 10, line 8, insert "escape" between "soil" and "passage".

Claim 38, line 4, claim 39, lines 1-2, and claim 40, line 2, delete "angle Φ" and insert in place thereof --angle ϕ--.

Claim 44, last line, delete "Of" and insert in place thereof --of--.

Claim 46, line 2, delete "blan" and insert in place thereof --plan--.

Signed and Sealed this

Fourteenth Day of November, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO : 5,511,506

DATED : April 30, 1996

INVENTOR(S) : BRUCE

It is certified that error appears in the above-identified patent and that said Letters Patent is hereby corrected as shown below:

In the Drawing:

In Figure 1, the lead line for reference numeral 18 should be applied to the forward upper minor surface of the fluke 2, as shown below:

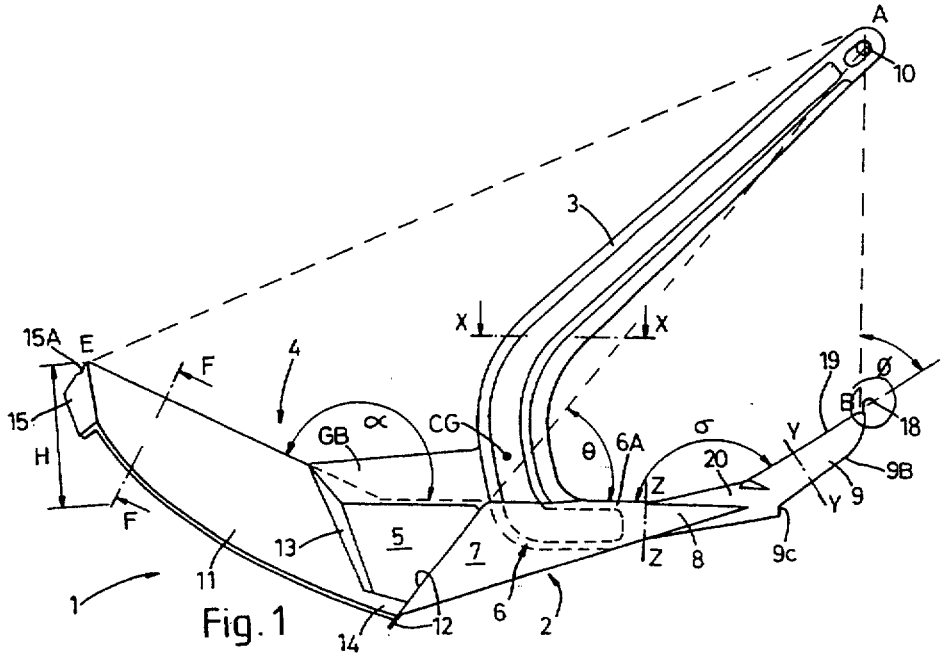

Fig. 1